US008783799B2

(12) United States Patent
Chen

(10) Patent No.: US 8,783,799 B2
(45) Date of Patent: Jul. 22, 2014

(54) SLIDING RAIL ASSEMBLY AUTO-OPENING MECHANISM

(71) Applicant: GSlide Corporation, Taipei Hsien (TW)

(72) Inventor: Yung Liang Chen, New Taipei (TW)

(73) Assignee: GSlide Corporation, Taipei Hsien (TW)

( * ) Notice: Subject to any disclaimer, the term of this patent is extended or adjusted under 35 U.S.C. 154(b) by 113 days.

(21) Appl. No.: 13/648,727

(22) Filed: Oct. 10, 2012

(65) Prior Publication Data

US 2013/0187524 A1 Jul. 25, 2013

(30) Foreign Application Priority Data

Jan. 20, 2012 (TW) ..... 101201588 A

(51) Int. Cl.
*A47B 88/04* (2006.01)

(52) U.S. Cl.
USPC ..... 312/333; 312/319.1

(58) Field of Classification Search
CPC ..... A47B 88/047; A47B 88/0477; A47B 88/0481; A47B 2210/0059
USPC ..... 312/330.1, 319.1, 333, 334.1, 334.7, 312/334.8, 334.44, 334.46, 334.47; 384/21, 384/22
See application file for complete search history.

(56) References Cited

U.S. PATENT DOCUMENTS

| | | | | |
|---|---|---|---|---|
| 619,516 | A | 2/1899 | Tillotson | |
| 1,477,278 | A | 12/1923 | O'Connor | |
| 7,244,005 | B1 * | 7/2007 | Lu | 312/333 |
| 7,347,515 | B1 | 3/2008 | Lu | |
| 8,256,853 | B2 * | 9/2012 | Chen et al. | 312/333 |
| 8,469,468 | B2 * | 6/2013 | Chen et al. | 312/333 |
| 2007/0108880 | A1 * | 5/2007 | Lu | 312/334.11 |

OTHER PUBLICATIONS

Photograph of magnetized push-to-open door catch. Applicant is not aware of when the prior art device shown in the photograph was first available to the public, but applicant became aware of it at least as early as Aug. 2011.

* cited by examiner

*Primary Examiner* — James O Hansen
(74) *Attorney, Agent, or Firm* — Cook Alex Ltd.

(57) ABSTRACT

A sliding rail assembly auto-opening mechanism and a sliding rail assembly in combination is disclosed, the sliding rail assembly auto-opening mechanism includes a holder block, a sliding block, a rotating member, a sliding hook, a spring and a link. The holder block provides a sliding slot connected to a locating notch that has a first steering-guiding portion and a second steering-guiding portion that engage a bottom block of the rotating member, with the bottom block having retaining grooves adapted to engage the first steering-guiding portion or second steering-guiding portion of the holder block, and the link is mounted on a sliding rail of the sliding rail assembly.

20 Claims, 22 Drawing Sheets

SLIDING RAIL ASSEMBLY AUTO-OPENING MECHANISM

BACKGROUND OF THE INVENTION

1. Field of the Invention

The present invention relates to sliding rail assemblies for drawers and more particularly, to a sliding rail assembly auto-opening mechanism, which consists of a limited number of component parts, requiring less labor and time to assemble, reducing much the production cost, and extending the auto eject distance of the drawer when the drawer is pressed to open.

2. Description of the Related Art

A conventional auto-opening mechanism for a drawer typically is installed on the back panel of a cabinet. When a user imparted a pressure to the face panel of the drawer to force the drawer rearward against the auto-opening mechanism, the auto-opening mechanism automatically would eject the drawer out of the cabinet. This prior design of an auto-opening mechanism still is not satisfactory in function and has drawbacks. To attempt to eliminate the drawbacks, U.S. Pat. No. 7,347,515 B1, an equivalent to Taiwan M281524, issued to the present inventor, and discloses a sliding rail assembly auto-opening mechanism that enables a drawer to be automatically opened when pressed, and then returned to the locked status when received in the cabinet. The design is functional, however, it still leaves room for improvement.

SUMMARY OF THE INVENTION

The present invention provides a sliding rail assembly auto-opening mechanism, which has a simple structure consisting of a limited number of component parts, requiring less labor and time to assemble, thereby reducing much of the production cost.

The present invention also provides a sliding rail assembly auto-opening mechanism, which extends the auto eject distance of the drawer when the drawer is pressed to open.

The present invention further provides a sliding rail assembly auto-opening mechanism, which has a buffering effect when the user pushes the drawer toward a closed position.

To achieve the above for the present invention, a sliding rail assembly auto-opening mechanism is mounted in a sliding rail assembly between a cabinet and a drawer, comprising a holder block mounted to the rear end of the outer rail, a sliding block, a spring, a rotating member, a sliding hook, and a link. The holder block comprises a longitudinal sliding track for supporting and guiding a sliding movement of the sliding block, a longitudinal sliding slot formed in the longitudinal sliding track and having a width, a locating notch disposed in the longitudinal sliding track and connected to the rear end of the longitudinal sliding slot and defining a first steering-guiding portion at a rear side thereof and a second steering-guiding portion at a front side thereof, a spring mounting portion disposed at a front end relative to the longitudinal sliding track, a guide groove disposed in communication with the longitudinal sliding slot and a sloping guide portion disposed at a front end of the guide groove. The sliding block comprises a sliding groove coupled to the holder block, a spring mounting portion, a first pivot hole pivotally coupled to the sliding hook and a second pivot hole pivotally coupled to the rotating member. The spring is connected between the spring mounting portion of the sliding block and the spring mounting portion of the holder block. The rotating member comprises a pivot pivotally coupled to the second pivot hole of the sliding block, a bottom block slidably coupled to the longitudinal sliding slot of the holder block and having a width smaller than the width of the longitudinal sliding slot of the holder block and a length greater than the width of the longitudinal sliding slot of the holder block, and two retaining grooves respectively located on opposing front and rear sides of the bottom block. The bottom block of the rotating member is stoppable at one of the first steering-guiding portion and second steering-guiding portion of the holder block and then rotated to let one of the retaining grooves be forced into engagement with the second steering-guiding portion. The sliding hook comprises a pivot located on a rear side thereof and pivotally coupled to the sliding block, a stop wall, a side notch located on a lateral side thereof forward of the stop wall and a hook portion disposed at a front side of the side notch. The link is connected to the inner sliding rail near the rearward end thereof, and comprises an actuation portion defining a recess and terminating in a hook portion adapted for engaging the hook portion of the sliding hook.

The design of the connected sliding slot and locating notch, first steering-guiding portion and second steering-guiding portion of the holder block, and the arrangement of the sliding block with the spring and the rotating member, enable the rotating member to be stopped at or engage the first steering-guiding portion or second steering-guiding portion of the holder block and then biased or rotated to force one retaining groove of the bottom block into engagement with the second steering-guiding portion of the holder block, facilitating operation and extending the automatic outward sliding distance upon an auto-opening action (the auto eject distance of the drawer when the drawer is pressed rearward to open), and therefore, the user can access to the inside of the drawer conveniently.

Further, when the user pushes the drawer rearward toward a closed position, the rear end of the intermediate sliding rail will touch the two front edges of the sliding block, providing a buffering effect.

DETAILED DESCRIPTION OF THE INVENTION

Figure 22:
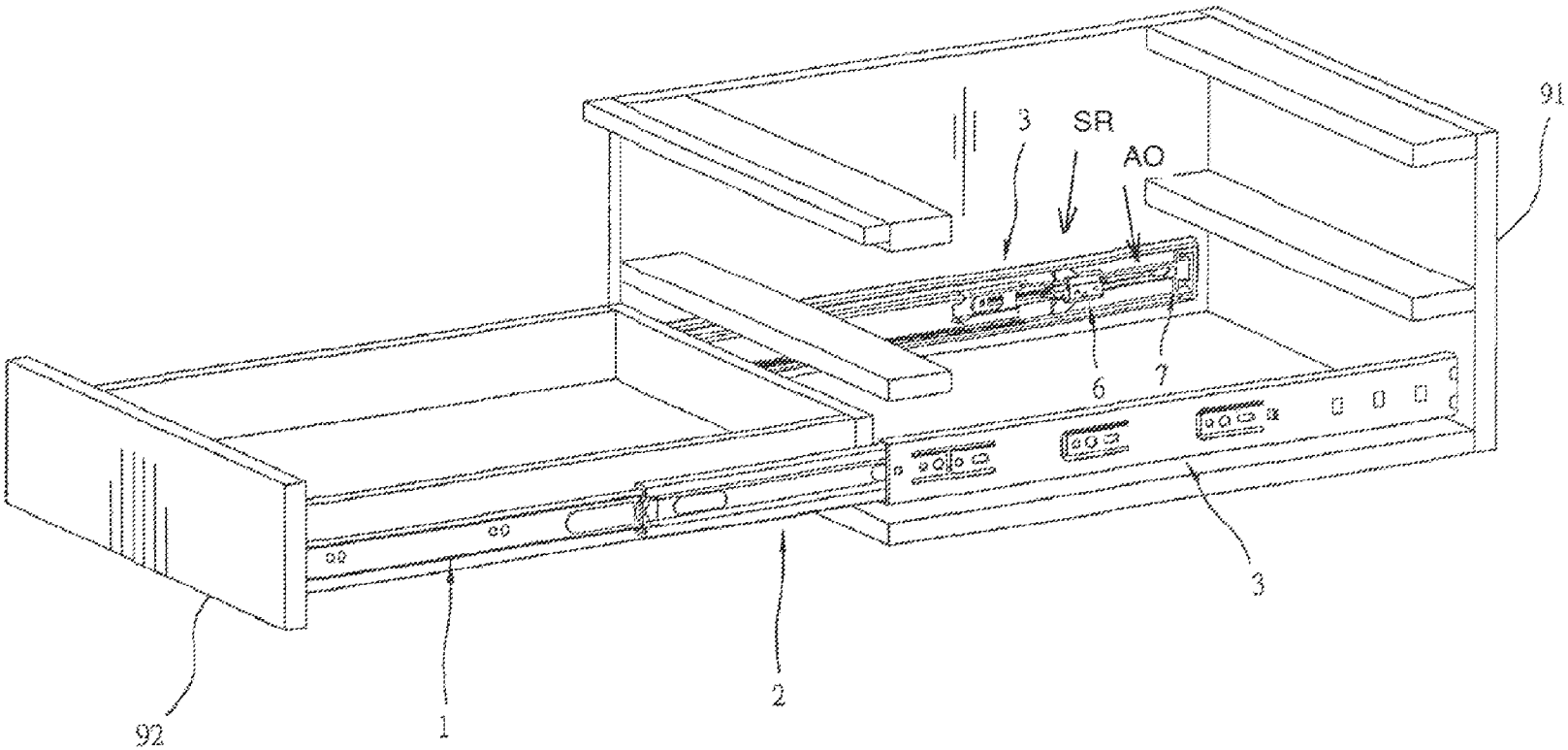
FIG. 22 is a schematic perspective view of the assembly shown in FIG. 21, illustrating the drawer extended out of the cabinet in an open position.

Referring to FIGS. 1-22, and as may be appreciated in FIG. 22, a sliding rail assembly auto-opening mechanism AO is shown mounted in a sliding rail assembly SR that is mounted between a cabinet 91 and a drawer 92. According to this embodiment, the sliding rail assembly SR comprises an outer rail 3, an intermediate sliding rail 2 axially movably mounted in the outer rail 3, an inner sliding rail 1 axially movably mounted in the intermediate sliding rail 2, a first bushing set (not shown) between the inner sliding rail 1 and the intermediate sliding rail 2, and a second bushing set (not shown) between the intermediate sliding rail 2 and the outer rail 3. The outer rail 3 is mounted on an inside wall of the cabinet 91 at a suitable location. The inner sliding rail 1 is mounted to one side panel of the drawer 92 that is receivable in the cabinet 91. By means of the sliding rail assembly SR, the drawer 92 is movable in and out of the cabinet 91.

As may be appreciated in FIGS. 1-12, the sliding rail assembly auto-opening mechanism AO comprises a holder block 7, a sliding block 6, a rotating member 8, a sliding hook 60, a spring 68, and a link 11.

Figure 1:
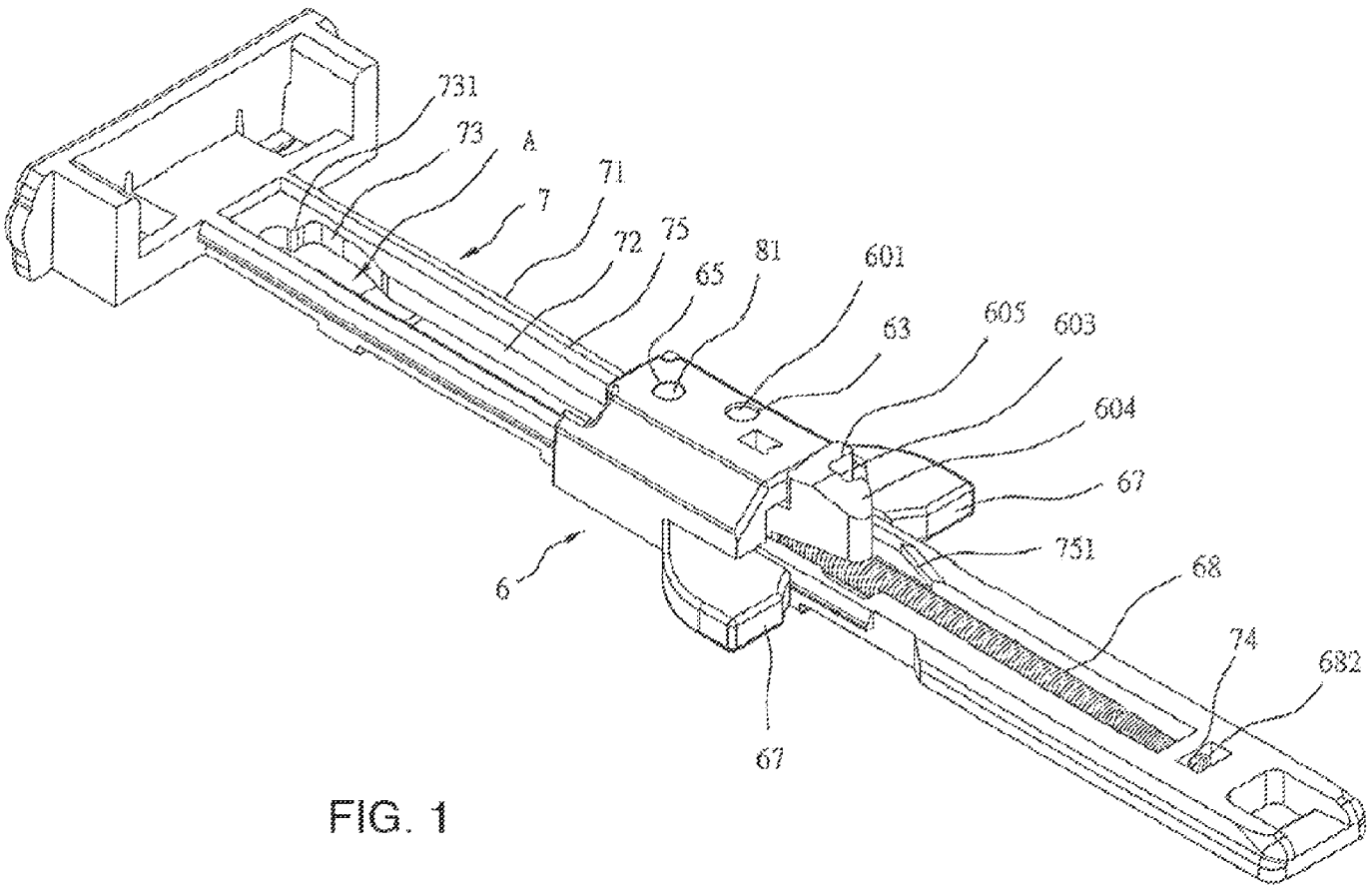
FIG. 1 is a top perspective view of a sliding rail assembly auto-opening mechanism according to the present invention.
Figure 2:
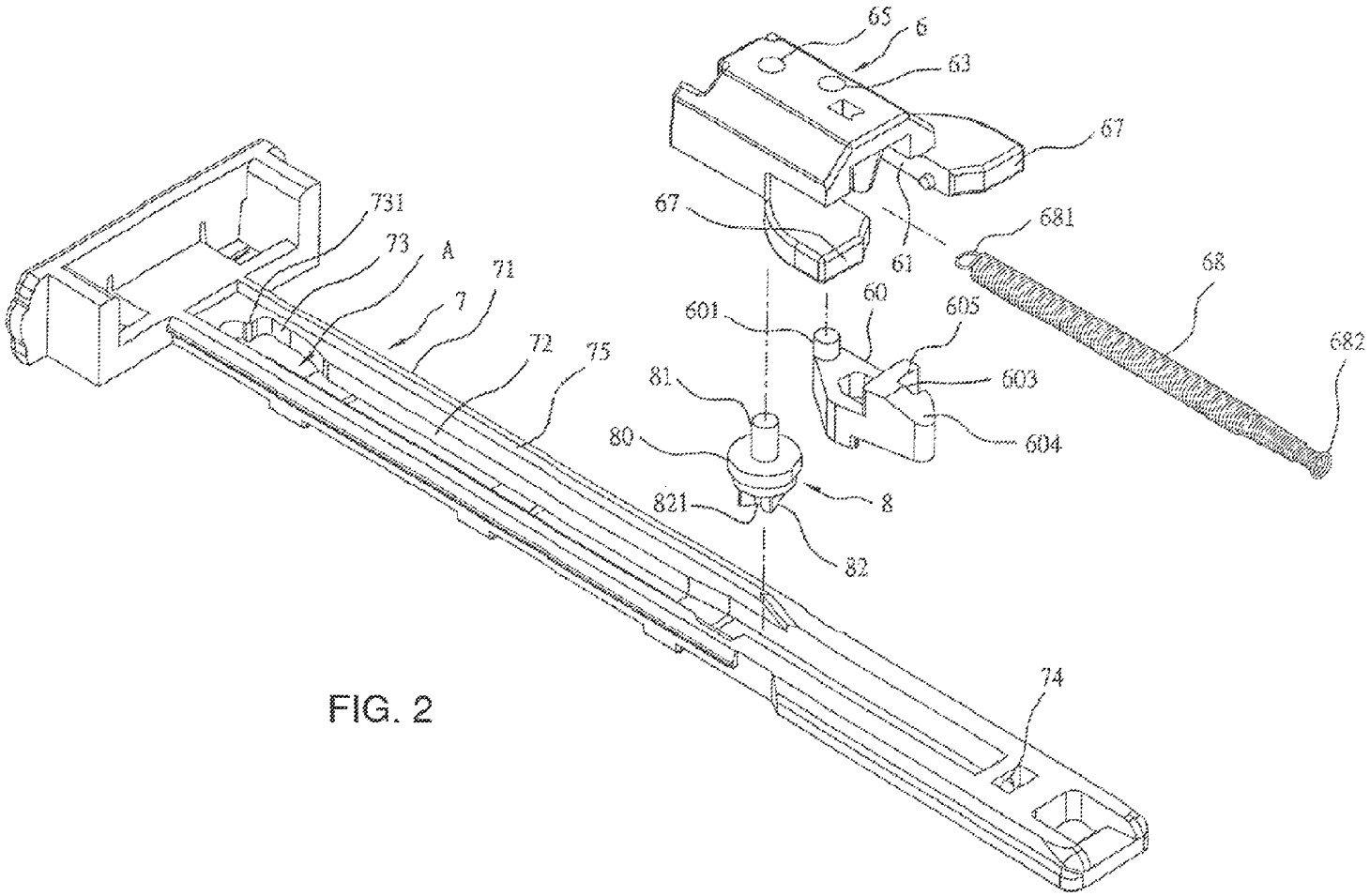
FIG. 2 is a top perspective exploded view of the sliding rail assembly auto-opening mechanism according to the present invention.
Figure 3:
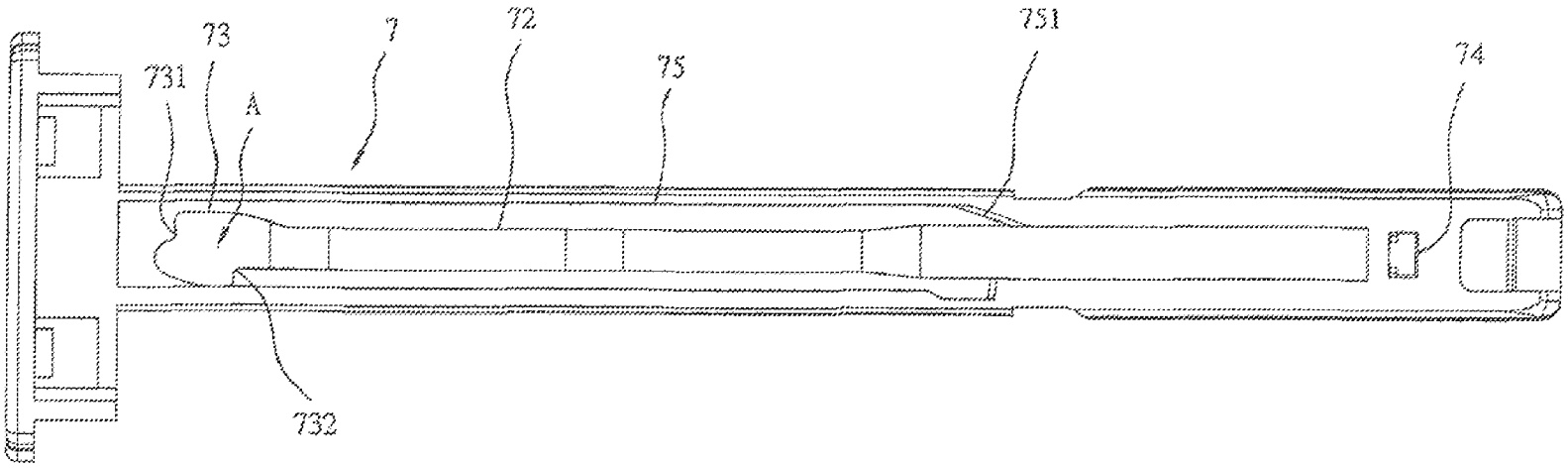
FIG. 3 is a top view of the holder block of the sliding rail assembly auto-opening mechanism according to the present invention.

The holder block 7 (see FIGS. 2, 3 and 5) is mounted to the rear end of the outer rail 3 of the sliding rail assembly SR, and comprises a longitudinal sliding track 71 for supporting and guiding the sliding movement of the sliding block 6, a longitudinal sliding slot 72 formed in the longitudinal sliding track 71 and having a width, a locating notch 73 disposed in the longitudinal sliding track 71 and connected to or in communication with the rear end of the longitudinal sliding slot 72 and defining a first steering-guiding portion 731 at a rear side thereof and a second steering-guiding portion 732 at a front side thereof, a spring mounting portion 74 disposed at a front end relative to the longitudinal sliding track 71, a guide groove 75 disposed in communication with the longitudinal sliding slot 72 (see FIG. 2), and a sloping guide portion 751 disposed at the front end of the guide groove 75 (see FIG. 3).

The sliding block 6 comprises a sliding groove 61 (see FIG. 2) coupled to the holder block 7 along the sliding track 71, two front edges 67, a spring mounting portion 62 (see FIG. 5), a first pivot hole 63 (or pivot) pivotally coupled to the sliding hook 60, and a second pivot hole 65 pivotally coupled to the rotating member 8.

The spring 68 has its first end 681 connected to the spring mounting portion 62 of the sliding block 6, and its second end 682 connected to the spring mounting portion 74 of the holder block 7.

Figure 4:
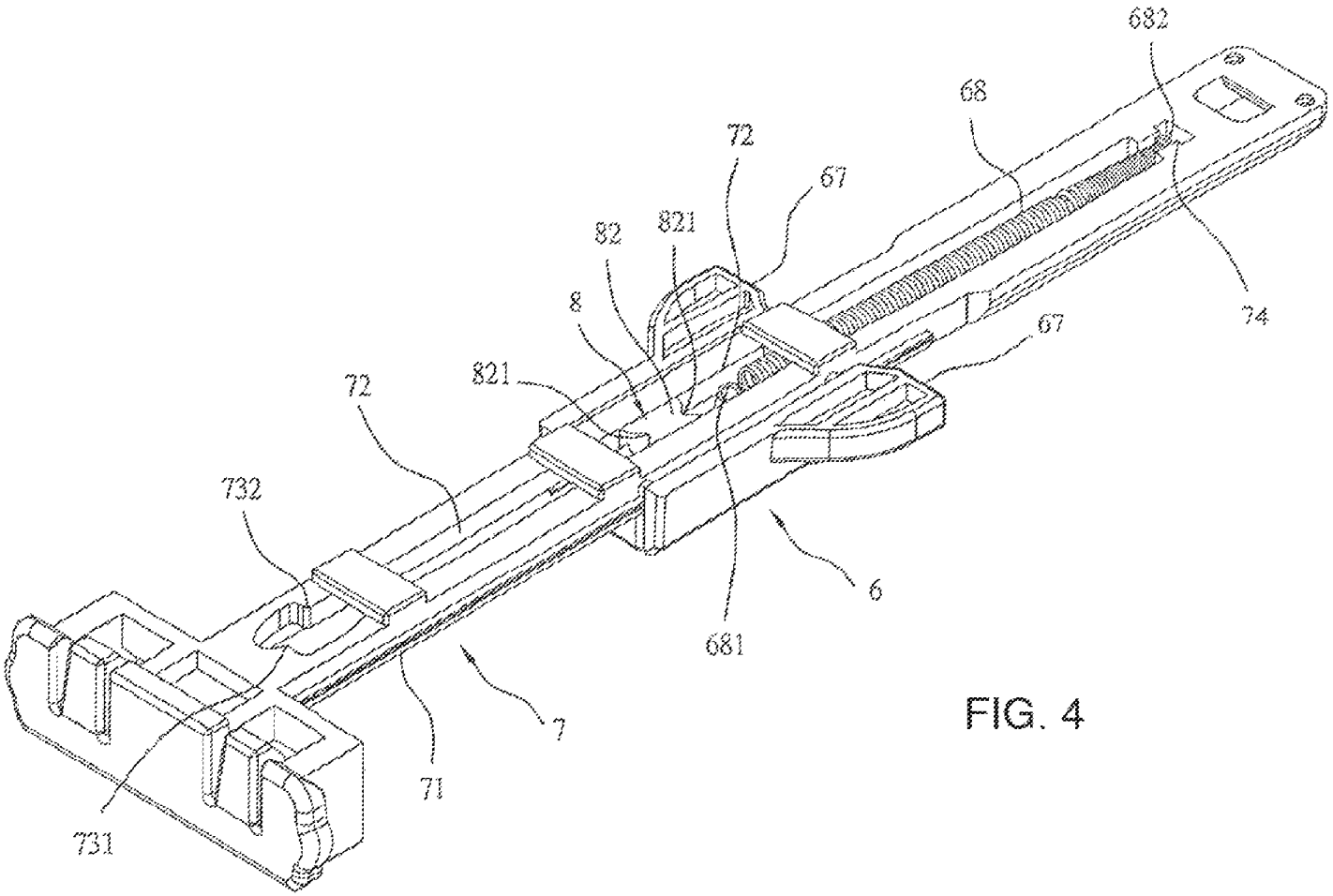
FIG. 4 is a bottom perspective view of the assembly of FIG. 1.
Figure 5:
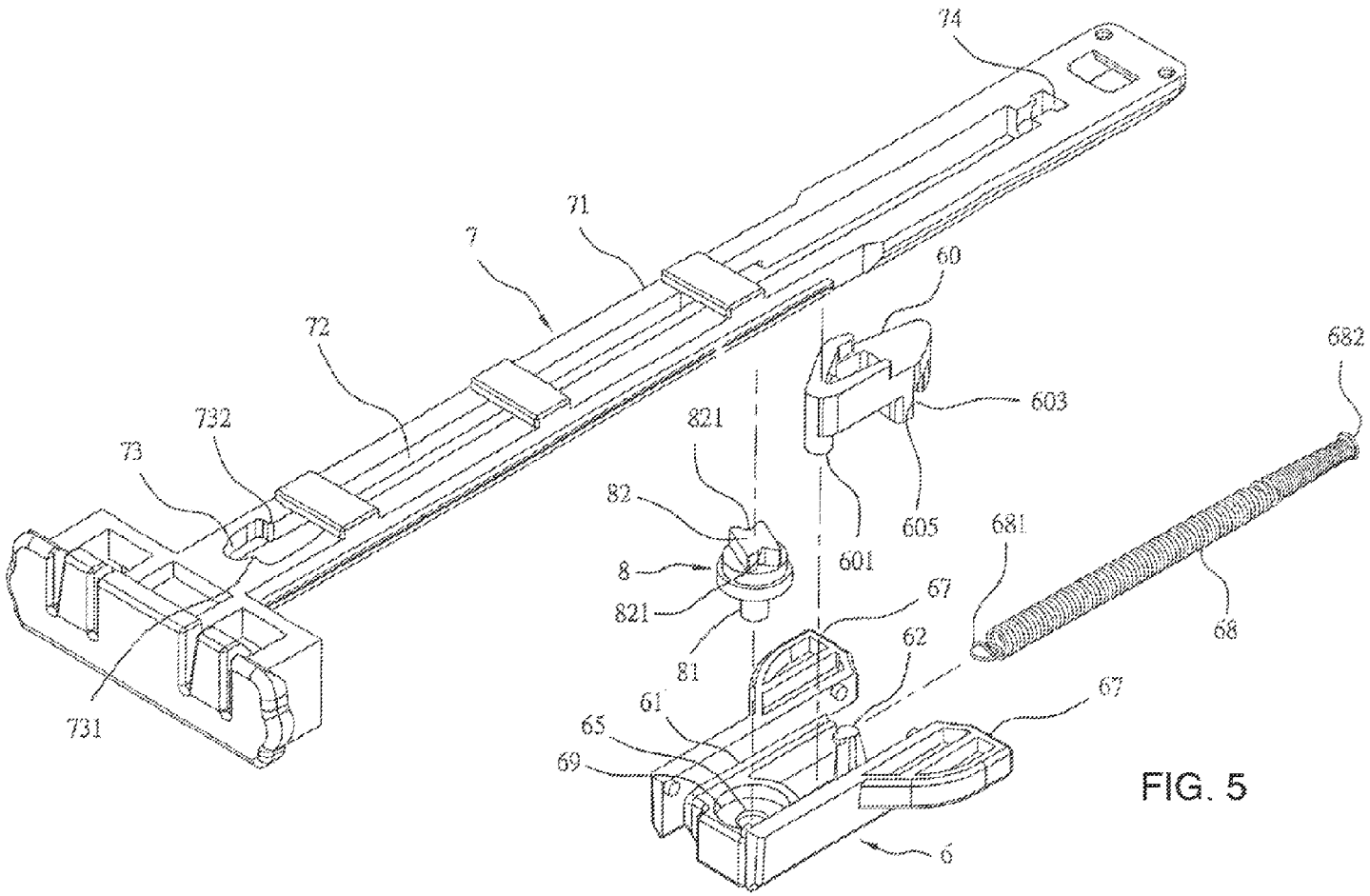
FIG. 5 is a bottom perspective exploded view of the assembly of FIG. 2.
Figure 6:
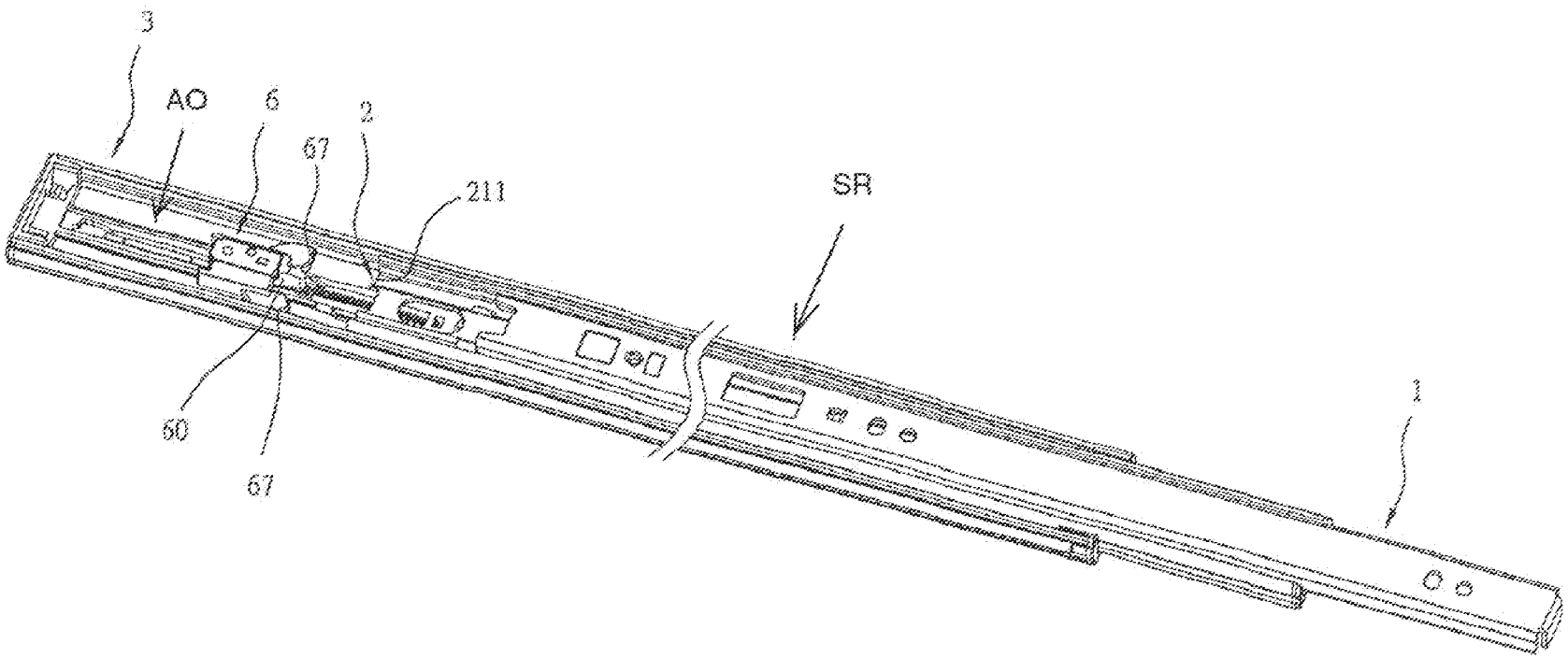
FIG. 6 is a perspective view illustrating the sliding rail assembly auto-opening mechanism mounted in a sliding rail assembly according to the present invention.
Figure 7:
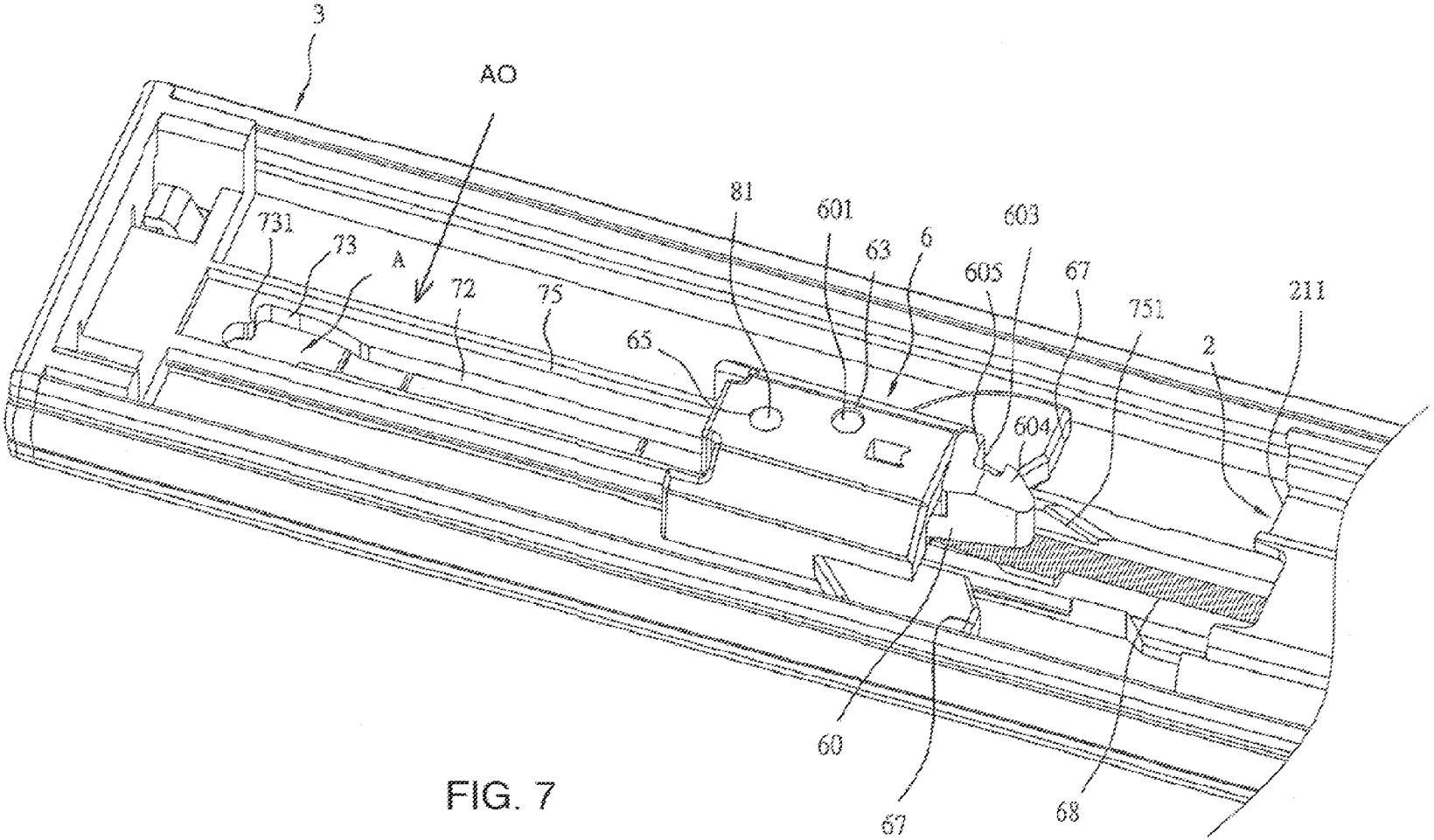
FIG. 7 is an enlarged perspective view of a rear portion of the assembly of FIG. 6.

The rotating member 8 comprises a pivot 81 (or post) pivotally coupled to the second pivot hole 65 of the sliding block 6, a bottom block 82 slidably coupled to the longitudinal sliding slot 72 of the holder block 7 (see FIGS. 4 and 11) and having a width smaller than the width of the longitudinal sliding slot 72 of the holder block 7 and a length greater than the width of the longitudinal sliding slot 72 of the holder block 7, and two retaining grooves 821 respectively located on the opposing front and rear sides of the bottom block 82 (see FIGS. 4 and 5). The bottom block 82 of the rotating member 8 can be stopped at the first steering-guiding portion 731 (see FIG. 14) or second steering-guiding portion 732 (see FIG. 15) of the holder block 7 and then rotated, enabling one retaining groove 821 to be forced into engagement with the second steering-guiding portion 732 (see FIGS. 15 and 16).

The sliding hook 60 (as shown in FIG. 2) comprises a pivot 601 (or post) located on the rear side thereof and pivotally coupled to the sliding block 6 such as at the first pivot hole 63, a stop wall 605, a side notch 603 located on a lateral side thereof forward of the stop wall 605, and a hook portion 604 disposed at the front side of the side notch 603. By means of the sloping guide portion 751 at the front side of the guide groove 75 of the holder block 7 (see FIG. 3), the sliding hook 60 can be biased or slightly rotated.

Figure 8:
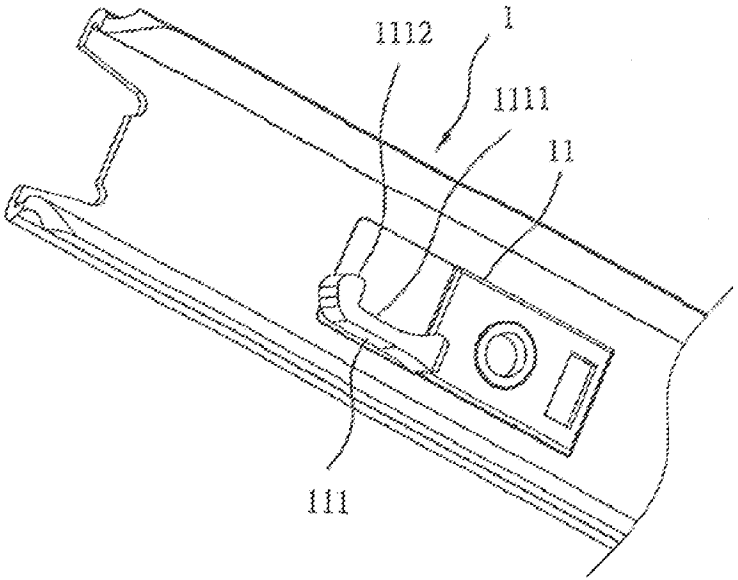
FIG. 8 is an enlarged perspective view of a rear portion of the inner sliding rail of the sliding rail assembly shown in FIG. 6, illustrating the positioning of the link of the sliding rail assembly auto-opening mechanism in the inner sliding rail.
Figure 9:
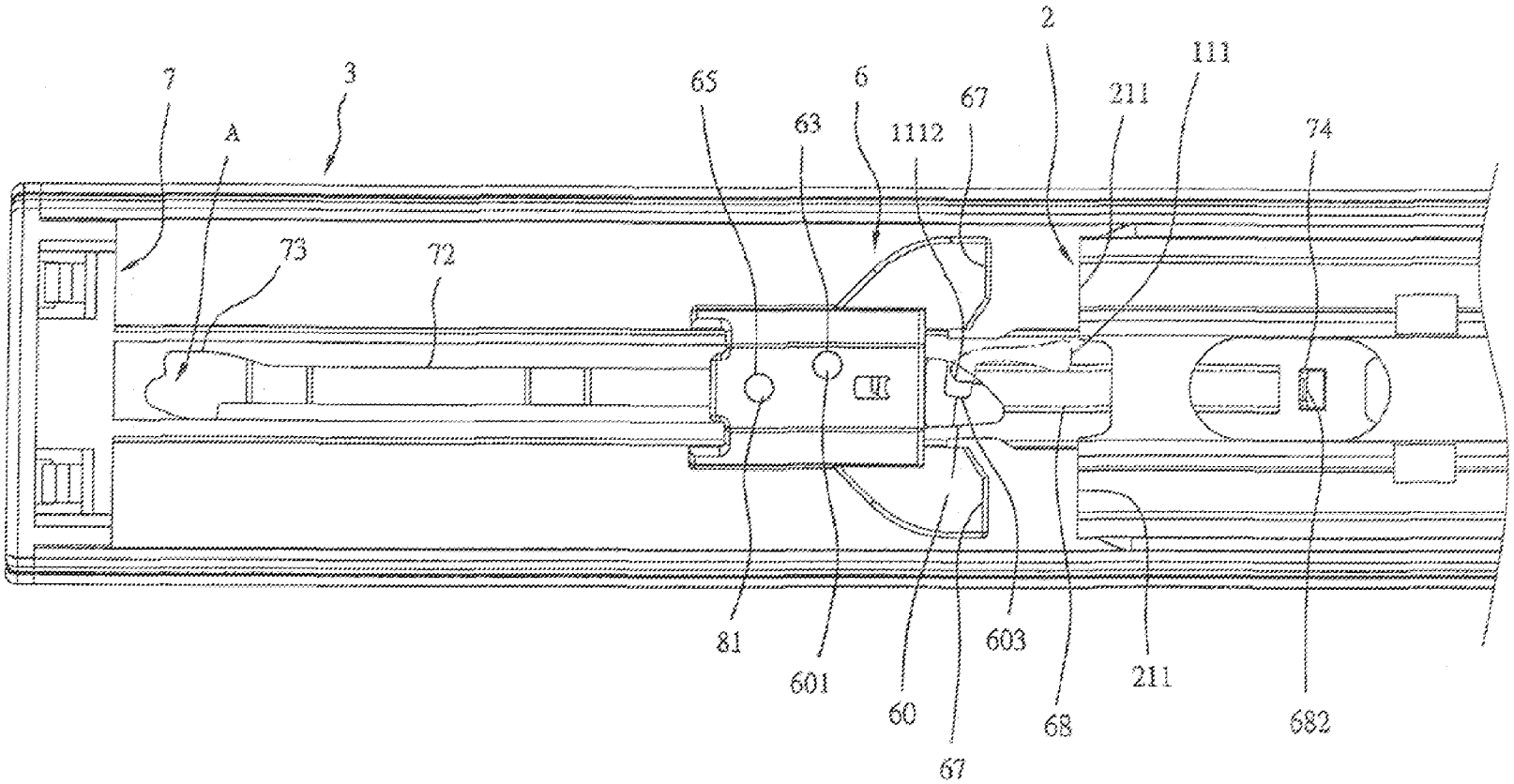
FIG. 9 is a schematic top view, in an enlarged scale, of the present invention, illustrating an opening status of the sliding rail assembly with a portion of the link shown in dashed lines.
Figure 10:
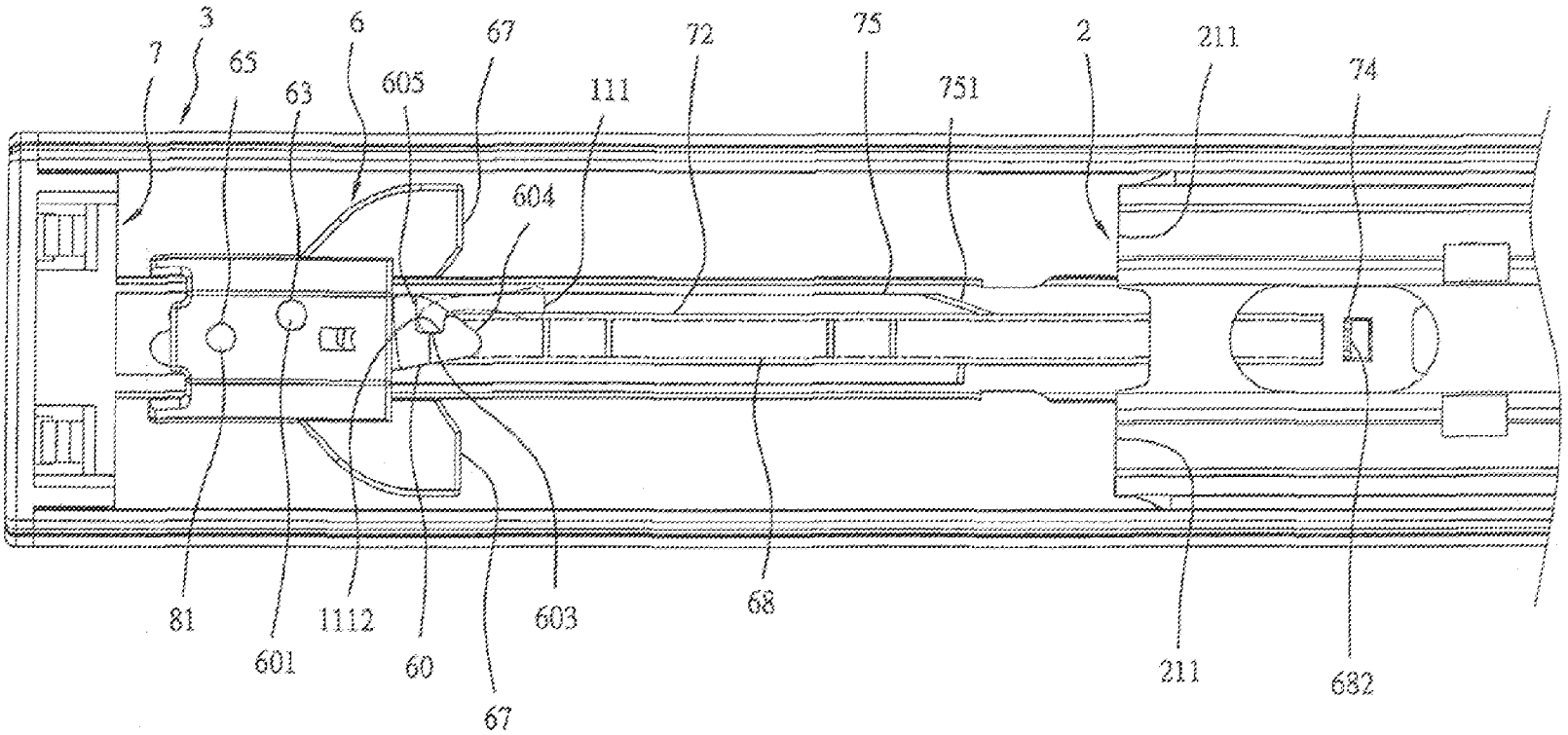
FIG. 10 is a schematic top view, in an enlarged scale, of the present invention, illustrating a closing status of the sliding rail assembly with a portion of the link shown in dashed lines.
Figure 11:
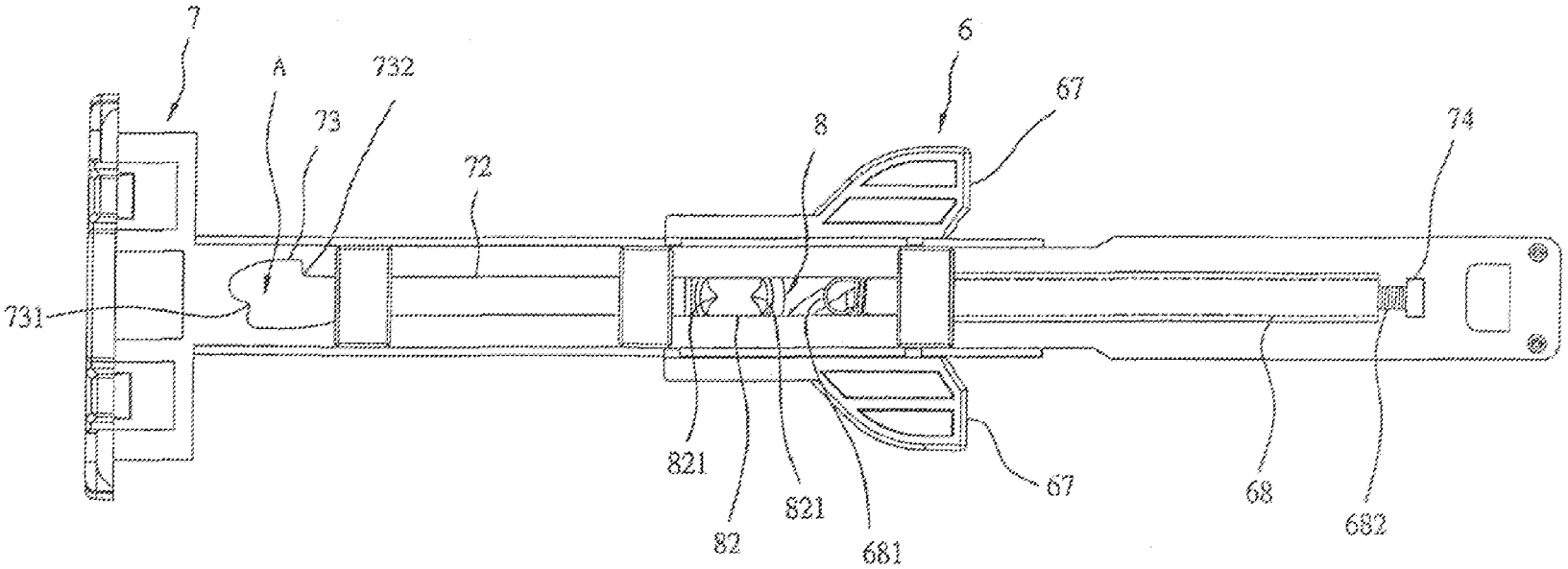
FIG. 11 is a schematic bottom view of the present invention, illustrating an opening status of the sliding rail assembly.
Figure 12:
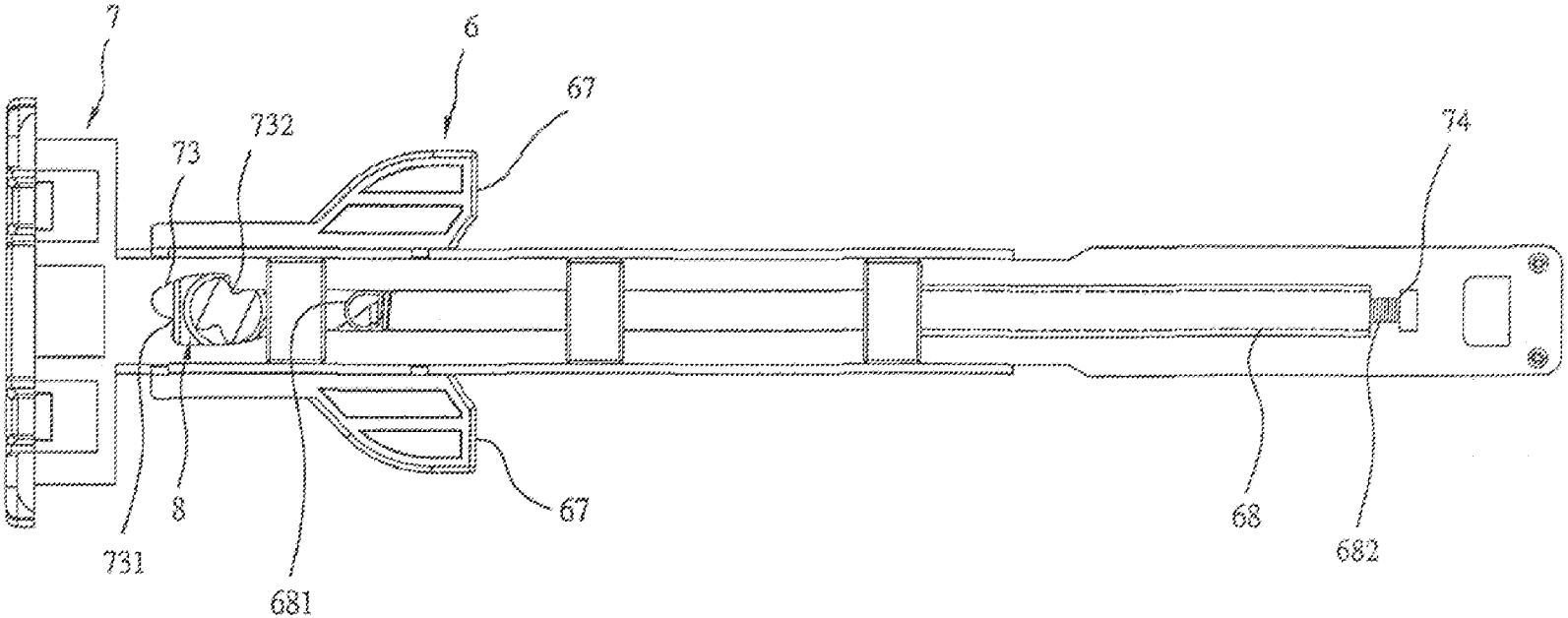
FIG. 12 is a schematic bottom view of the present invention, illustrating a closing status of the sliding rail assembly.
Figure 13:
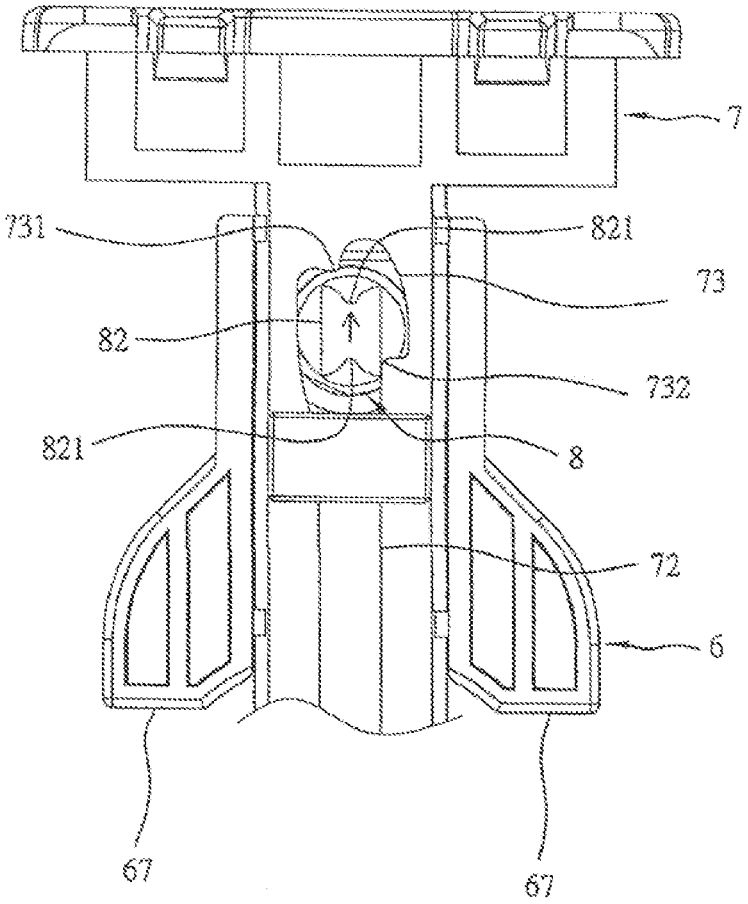
FIG. 13 is a schematic bottom view of a portion of the present invention, illustrating an operation status of the sliding rail assembly auto-opening mechanism.
Figure 14:
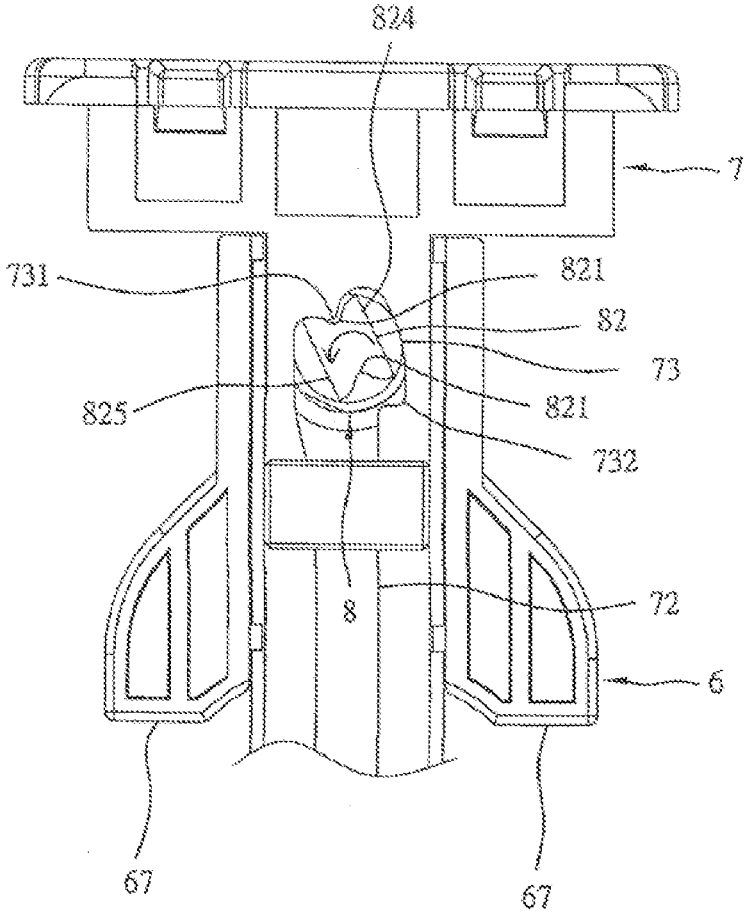
FIG. 14 is a schematic bottom view of a portion of the present invention, illustrating another operation status of the sliding rail assembly auto-opening mechanism.
Figure 15:
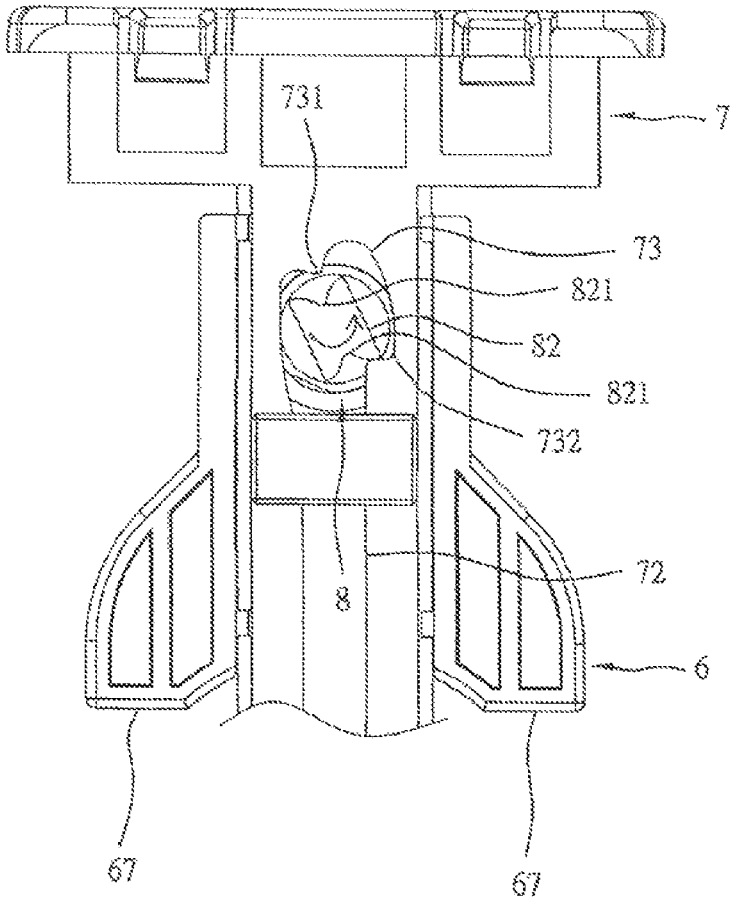
FIG. 15 is a schematic bottom view of a portion of the present invention, illustrating still another operation status of the sliding rail assembly auto-opening mechanism.
Figure 16:
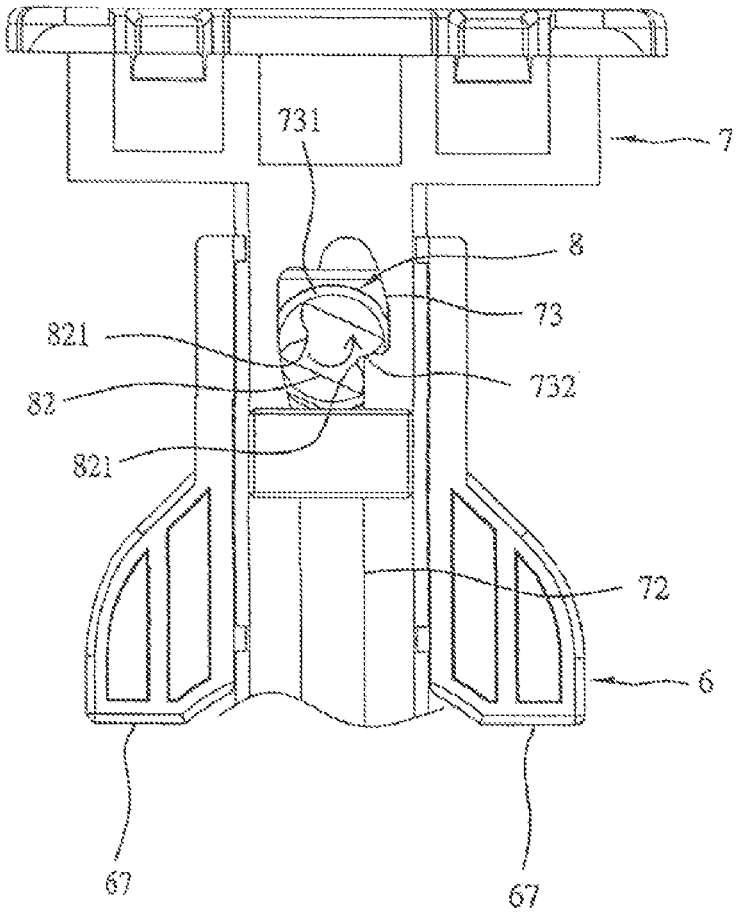
FIG. 16 is a schematic bottom view of a portion of the present invention, illustrating still another operation status of the sliding rail assembly auto-opening mechanism.
Figure 17:
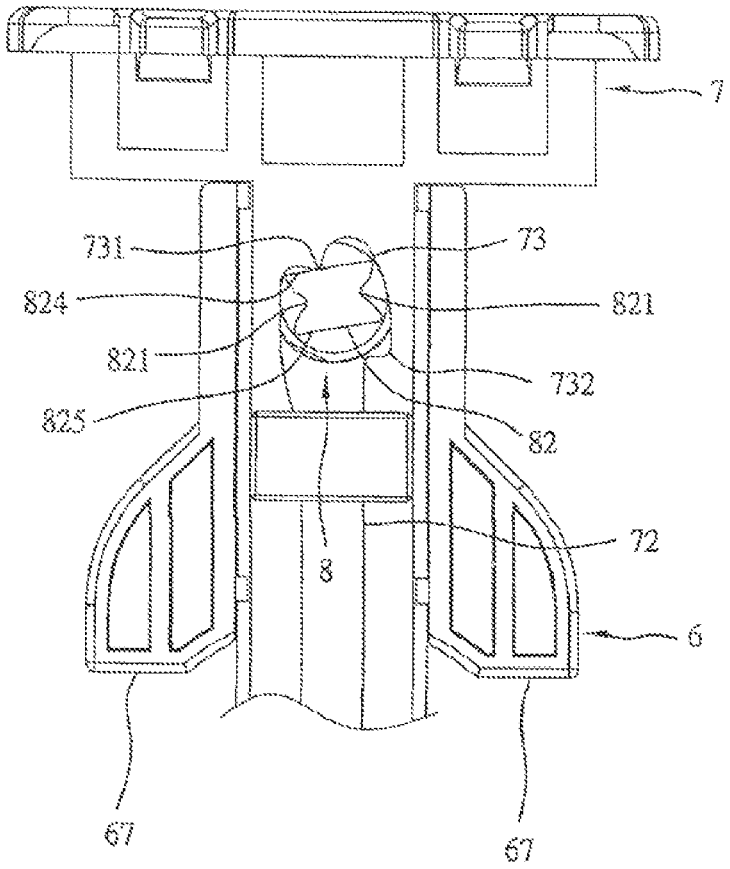
FIG. 17 is a schematic bottom view of a portion of the present invention, illustrating still another operation status of the sliding rail assembly auto-opening mechanism.
Figure 18:
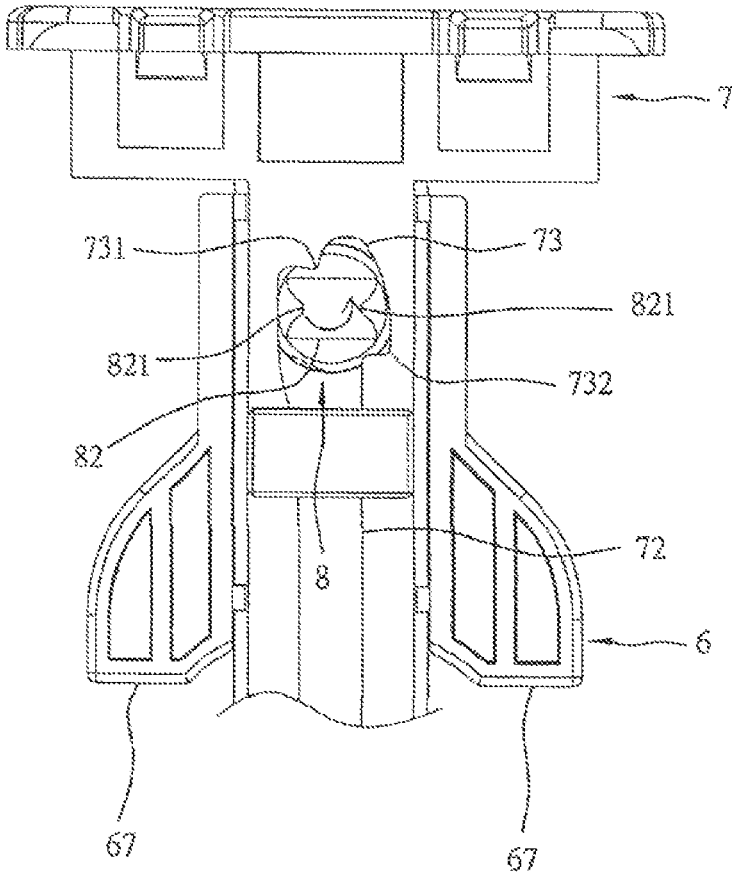
FIG. 18 is a schematic bottom view of a portion of the present invention, illustrating still another operation status of the sliding rail assembly auto-opening mechanism.
Figure 19:
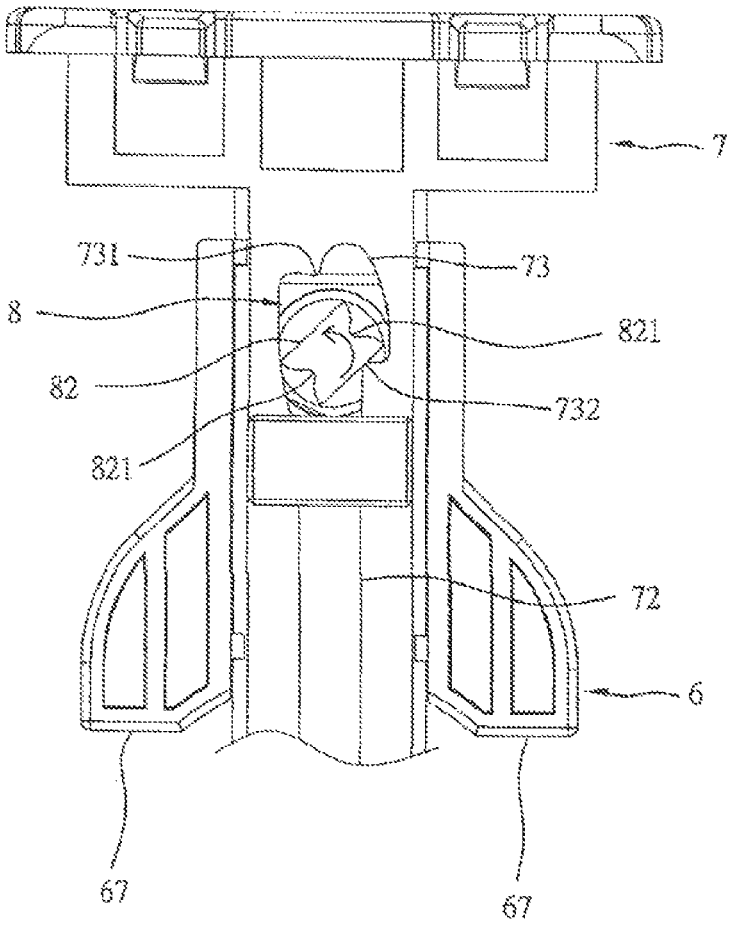
FIG. 19 is a schematic bottom view of a portion of the present invention, illustrating still another operation status of the sliding rail assembly auto-opening mechanism.
Figure 20:
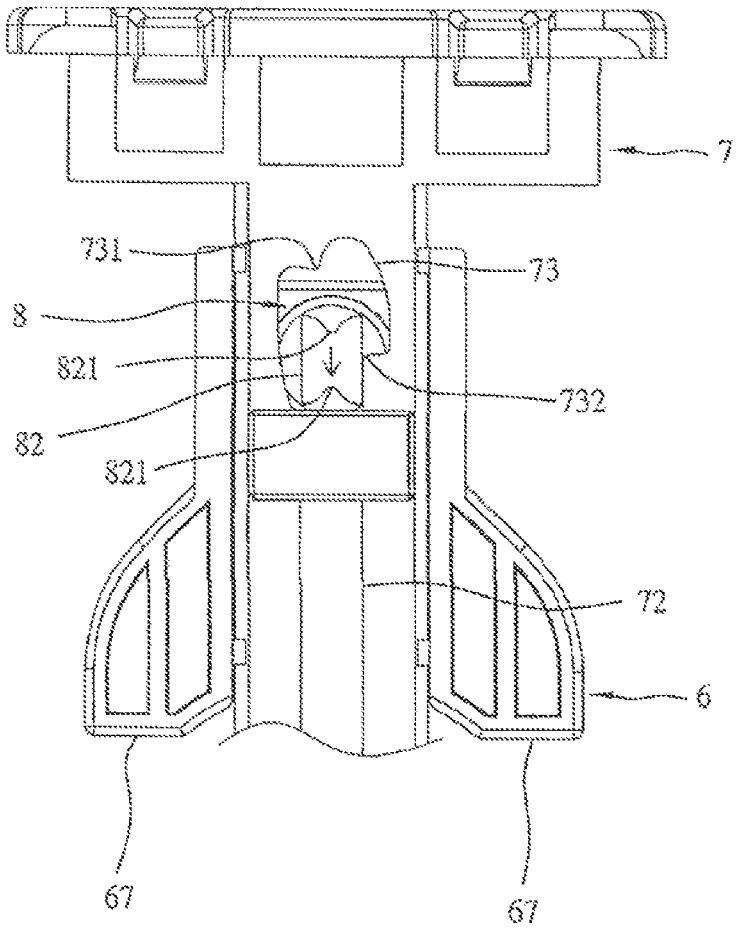
FIG. 20 is a schematic bottom view of a portion of the present invention, illustrating still another operation status of the sliding rail assembly auto-opening mechanism.
Figure 21:
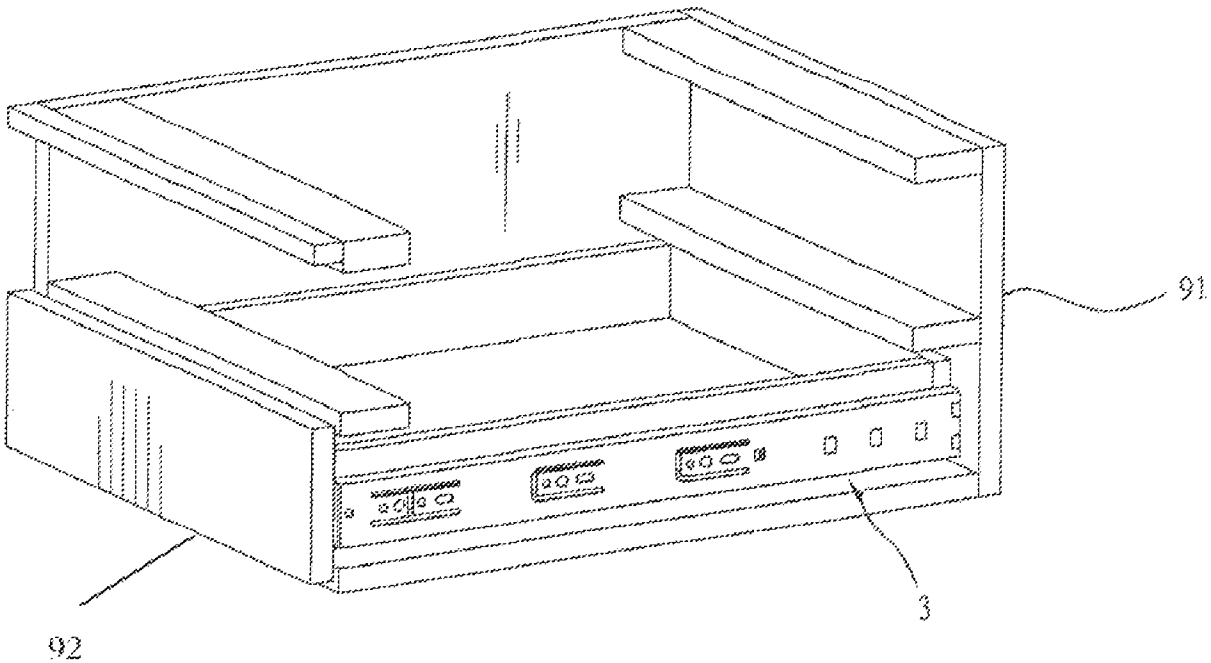
FIG. 21 is a schematic perspective view of the present invention, illustrating the sliding rail assembly auto-opening mechanism mounted in a sliding rail assembly that is mounted between a cabinet and a drawer, with the drawer in a closed position.

The link 11 (as shown in FIG. 8) is fixedly connected to the inner sliding rail 1 near the rear end thereof, and comprises an actuation portion 111 defining a recess 1111 and terminating in a hook portion 1112.

When the drawer 92 is being moved toward a closed position (see FIG. 9), the hook portion 1112 of the actuation portion 111 of the link 11 is hooked up with the hook portion 604 of the sliding hook 60, and once the drawer 92 is closed (see FIGS. 10, 12 and 21) one retaining groove 821 of the rotating member 8 is forced into engagement with the second steering-guiding portion 732 of the holder block 7 (see FIGS. 13-16). Then, when applying a pressure to the front side of the drawer 92 to move the drawer 92 rearward from a resting closed position (see FIGS. 16 and 22), the hook portion 1112 of the actuation portion 111 of the link 11 will be forced against the back wall 605 of the sliding hook 60 to move the sliding hook 60 and the sliding block 6 rearward, and at the same time, one sidewall 824 of the bottom block 82 of the rotating member 8 will be stopped against the first steering-guiding portion 731 of the holder block 7 (see FIG. 17) and then rotated through an angle. Thereafter, the sliding block 6 will be moved forward by the spring force of the spring 68, causing an opposite sidewall 825 of the bottom block 82 of the rotating member 8 to engage the second steering-guiding portion 732 of the holder block 7 and then to be biased or directed into the rear side of the longitudinal sliding slot 72

(see FIGS. 18-20), enabling the rotating member 8 to be moved forward with the sliding block 6. During forward movement of the rotating member 8 with the sliding block 6, the sliding hook 60 is moved forwardly along the guide groove 75 of the holder block 7 and then biased or directed along the sloping guide portion 751 (see FIG. 7) to the extent where the hook portion 1112 of the actuation portion 111 of the link 11 is disengaged from the hook portion 604 of the sliding hook 60 (see FIG. 9), allowing the inner sliding rail 1 to be moved with the drawer 92 outwardly from the closed position within the cabinet 91 to the open position, while the sliding block 6 remains at rest in its forward most position.

When the drawer 92 is pushed rearward from the open position toward its former closed position, the inner sliding rail 1 is moved rearward with the drawer 92, and the hook portion 1112 of the actuation portion 111 of the link 11 is forced against the back wall 605 of the sliding hook 60 to bias or rotate the sliding hook 60, causing the sliding hook 60 to move along the sloping guide portion 751 of the guide groove 75 of the holder block 7 into the guide groove 75, so that the sliding block 6 is moved rearward with the sliding hook 60. During rearward movement of the sliding block 6 (see FIG. 11), the spring 68 is stretched between the spring mounting portion 62 of the sliding block 6 and the spring mounting portion 74 of the of the holder block 7. When one end of the rear side of the rotating member 8 engages the first steering-guiding portion 731 of the holder block 7 (see FIGS. 13 and 14), the rotating member 8 is biased or forced to rotate through an angle to the position where one retaining groove 821 of the rotating member 8 faces toward the second steering-guiding portion 732 of the holder block 7 (see FIG. 14), enabling the sliding block 6 to be pulled forward by the spring force of the spring 68 and the rotating member 8 to be moved with the sliding block 6 into engagement with the second steering-guiding portion 732 of the holder block 7 (see FIG. 15). Thereafter, one retaining groove 821 of the rotating member 8 is forced into engagement with the second steering-guiding portion 732 of the holder block 7 (see FIGS. 12 and 16), holding the drawer 92 in the closed position (see FIGS. 12 and 21), ready for a next auto-opening operation.

Further, the locating notch 73 of the holder block 7 defines a widened area A between the first steering-guiding portion 731 and the second steering-guiding portion 732 (see FIG. 3). This widened area A has a width greater than the length of the bottom block 82 of the rotating member 8, facilitating biasing or rotational redirection of the rotating member 8.

Further, the rotating member 8 comprises a disk-like base 80 connected between the pivot 81 (or post) and the bottom block 82 (see FIG. 2). The sliding block 6 comprises a circular bottom chamber 69 disposed in communication with the second pivot hole 65 (see FIG. 5) and adapted for pivotally accommodating the disk-like base 80 of the rotating member 8.

As indicated above, the invention provides a sliding rail assembly auto-opening mechanism AO, which has the advantages and features as follows:

1. The sliding rail assembly auto-opening mechanism AO consists of a limited number of component parts, i.e., the holder block 7, the sliding block 6, the rotating member 8, the sliding hook 60, the spring 68 and the link 11 that can easily be assembled, requiring less labor and time and reducing the production cost.

2. The design of the connected sliding slot 72 and locating notch 73, first steering-guiding portion 731 and second steering-guiding portion 732 of the holder block 7 and the arrangement of the sliding block 6 with the spring 68 and the rotating member 8 enable the rotating member 8 to be stopped at or engage the first steering-guiding portion 731 or second steering-guiding portion 732 of the holder block 7 and then biased or rotated to force one retaining groove 821 of the bottom block 82 into engagement with the second steering-guiding portion 732 of the holder block 7, facilitating operation and extending the automatic outward sliding distance upon an auto-opening action (the auto eject distance of the drawer when the drawer is pressed to open), and therefore the user can access to the inside of the drawer 92 conveniently.

3. When the user pushes the drawer 92 rearward, the rear end 211 of the intermediate sliding rail 2 will engage the two front edges 67 of the sliding block 6, providing a buffering effect.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A sliding rail assembly auto-opening mechanism mounted in a sliding rail assembly that is mounted between a cabinet and a drawer, the sliding rail assembly comprising an outer rail, an intermediate sliding rail axially movably mounted in the outer rail, an inner sliding rail axially movably mounted in the intermediate sliding rail, a first bushing set between the inner sliding rail and the intermediate sliding rail, and a second bushing set between the intermediate sliding rail and the outer rail, the outer rail being mounted on an inside wall of the cabinet, the inner sliding rail being mounted to one side panel of the drawer that is receivable in the cabinet, the sliding rail assembly auto-opening mechanism comprising:

a holder block mounted to a rear end of the outer rail of the sliding rail assembly, the holder block comprising a longitudinal sliding track that supports and guides sliding movement of a sliding block, a longitudinal sliding slot formed in the longitudinal sliding track and having a width, a locating notch disposed in the longitudinal sliding track and connected to a rear end of the longitudinal sliding slot and defining a first steering-guiding portion at a rear side thereof and a second steering-guiding portion at a front side thereof, a spring mounting portion disposed at a front end relative to the longitudinal sliding track, a guide groove disposed in communication with the longitudinal sliding slot and a sloping guide portion disposed at a front end of the guide groove;

the sliding block comprising a sliding groove slidably coupled to the holder block, a spring mounting portion, a first pivot hole pivotally coupled to a sliding hook and a second pivot hole pivotally coupled to a rotating member;

a spring having a first end connected to the spring mounting portion of the sliding block and a second end connected to the spring mounting portion of the holder block;

the rotating member comprising a pivot pivotally coupled to the second pivot hole of the sliding block, a bottom block slidably coupled to the longitudinal sliding slot of the holder block, the bottom block having a width smaller than the width of the longitudinal sliding slot of the holder block and a length greater than the width of the longitudinal sliding slot of the holder block, and two retaining grooves respectively located on opposing front and rear sides of the bottom block, the bottom block of the rotating member being configured to engage one of the first steering-guiding portion and the second steering-guiding portion of the holder block and then to rotate to let one of the retaining grooves be forced into engagement with the second steering-guiding portion;

the sliding hook comprising a pivot located on a rear side thereof and being pivotally coupled to the sliding block, a stop wall, a side notch located on a lateral side thereof forward of the stop wall and a hook portion disposed at a front side of the side notch; and a link connected to the inner sliding rail near a rearward end thereof, the link comprising an actuation portion defining a recess and terminating in a hook portion adapted to engage the hook portion of the sliding hook.

2. The sliding rail assembly auto-opening mechanism as claimed in claim 1, wherein the locating notch of the holder block defines a widened area between the first steering-guiding portion and the second steering-guiding portion, wherein the widened area has a width greater than the length of the bottom block of the rotating member.

3. The sliding rail assembly auto-opening mechanism as claimed in claim 1, wherein the rotating member further comprises a disk-like base connected between the pivot and bottom block thereof, wherein the sliding block comprises a circular bottom chamber disposed in communication with the second pivot hole thereof and adapted for pivotally accommodating the disk-like base of the rotating member.

4. The sliding rail assembly auto-opening mechanism as claimed in claim 1, wherein the sloping guide portion disposed at the front end of the guide groove of the holder block biases the sliding hook to rotate.

5. The sliding rail assembly auto-opening mechanism as claimed in claim 4, wherein when the sliding hook is moved to the front end of the guide groove of the holder block the sliding hook is biased by the sloping guide portion to rotate to a position to release the hook portion of the link member.

6. The sliding rail assembly auto-opening mechanism as claimed in claim 5, wherein when the sliding hook has released the hook portion of the link member, the sliding hook is held at the front end of the guide groove by the spring.

7. The sliding rail assembly auto-opening mechanism as claimed in claim 6, wherein when the sliding hook is held at the front end of the guide groove by the spring the sliding hook is disposed in a position to receive the hook portion of the link member.

8. The sliding rail assembly auto-opening mechanism as claimed in claim 1, wherein the sliding block provides a buffering effect when engaged by the intermediate sliding rail.

9. A sliding rail assembly auto-opening mechanism and a sliding rail assembly in combination, the sliding rail assembly comprising an outer rail, an intermediate sliding rail slidably mounted in the outer rail, an inner sliding rail slidably mounted in the intermediate sliding rail, the sliding rail assembly auto-opening mechanism comprising:

a holder block mounted to a rear end of the outer rail of the sliding rail assembly, the holder block comprising a longitudinal sliding track that supports and guides sliding movement of a sliding block, a longitudinal sliding slot formed in the longitudinal sliding track and having a width, a locating notch disposed in the longitudinal sliding track and connected to a rear end of the longitudinal sliding slot and defining a first steering-guiding portion at a rear side thereof and a second steering-guiding portion at a front side thereof, a spring mounting portion disposed at a front end relative to the longitudinal sliding track, a guide groove disposed in communication with the longitudinal sliding slot and a sloping guide portion disposed at a front end of the guide groove;

the sliding block comprising a sliding groove slidably coupled to the holder block, a spring mounting portion, a first pivot hole pivotally coupled to a sliding hook and a second pivot hole pivotally coupled to a rotating member;

a spring having a first end connected to the spring mounting portion of the sliding block and a second end connected to the spring mounting portion of the holder block;

the rotating member comprising a pivot pivotally coupled to the second pivot hole of the sliding block, a bottom block slidably coupled to the longitudinal sliding slot of the holder block, the bottom block having a width smaller than the width of the longitudinal sliding slot of the holder block and a length greater than the width of the longitudinal sliding slot of the holder block, and two retaining grooves respectively located on opposing front and rear sides of the bottom block, the bottom block of the rotating member being configured to engage one of the first steering-guiding portion and the second steering-guiding portion of the holder block and then to rotate to let one of the retaining grooves be forced into engagement with the second steering-guiding portion;

the sliding hook comprising a pivot located on a rear side thereof and being pivotally coupled to the sliding block, a stop wall, a side notch located on a lateral side thereof forward of the stop wall and a hook portion disposed at a front side of the side notch; and a link connected to the inner sliding rail near a rearward end thereof and comprising a hook portion adapted to engage the hook portion of the sliding hook.

10. The sliding rail assembly auto-opening mechanism and a sliding rail assembly combination as claimed in claim 9, wherein the locating notch of the holder block defines a widened area between the first steering-guiding portion and the second steering-guiding portion.

11. The sliding rail assembly auto-opening mechanism and a sliding rail assembly combination as claimed in claim 10, wherein the widened area has a width greater than the length of the bottom block of the rotating member.

12. The sliding rail assembly auto-opening mechanism and a sliding rail assembly combination as claimed in claim 9, wherein the rotating member further comprises a disk-like base connected between the pivot and bottom block thereof.

13. The sliding rail assembly auto-opening mechanism and a sliding rail assembly combination as claimed in claim 12, wherein the sliding block comprises a circular bottom chamber disposed in communication with the second pivot hole thereof and adapted for pivotally accommodating the disk-like base of the rotating member.

14. The sliding rail assembly auto-opening mechanism and a sliding rail assembly combination as claimed in claim 9, wherein the sloping guide portion disposed at the front end of the guide groove of the holder block biases the sliding hook to rotate.

15. The sliding rail assembly auto-opening mechanism and a sliding rail assembly combination as claimed in claim 14, wherein when the sliding hook is moved to the front end of the guide groove of the holder block the sliding hook is biased by the sloping guide portion to rotate to a position to release the hook portion of the link member.

16. The sliding rail assembly auto-opening mechanism and a sliding rail assembly combination as claimed in claim 15, wherein when the sliding hook has released the hook portion of the link member, the sliding hook is held at the front end of the guide groove by the spring.

17. The sliding rail assembly auto-opening mechanism and a sliding rail assembly combination as claimed in claim 16, wherein when the sliding hook is held at the front end of the guide groove by the spring the sliding hook is disposed in a position to receive the hook portion of the link member.

18. The sliding rail assembly auto-opening mechanism and a sliding rail assembly combination as claimed in claim 9, wherein the sliding block provides a buffering effect when engaged by the intermediate sliding rail.

19. A sliding rail assembly auto-opening mechanism for a sliding rail assembly that includes at least a first and a second sliding rail, the sliding rail assembly auto-opening mechanism comprising:

a holder block adapted to be mounted to a first sliding rail of the sliding rail assembly, the holder block comprising a longitudinal sliding track that supports and guides sliding movement of a sliding block, a longitudinal sliding slot formed in the longitudinal sliding track and having a width, a locating notch disposed in the longitudinal sliding track and connected to a rear end of the longitudinal sliding slot and defining a first steering-guiding portion at a rear side thereof and a second steering-guiding portion at a front side thereof, a spring mounting portion disposed at a front end relative to the longitudinal sliding track, a guide groove disposed in communication with the longitudinal sliding slot and a sloping guide portion disposed at a front end of the guide groove;

the sliding block comprising a sliding groove slidably coupled to the holder block, a spring mounting portion, a first pivot hole pivotally coupled to a sliding hook and a second pivot hole pivotally coupled to a rotating member;

a spring having a first end connected to the spring mounting portion of the sliding block and a second end connected to the spring mounting portion of the holder block;

a rotating member pivotally coupled to the sliding block and comprising a bottom block slidably coupled to the longitudinal sliding slot of the holder block, the bottom block having a width smaller than the width of the longitudinal sliding slot of the holder block and a length greater than the width of the longitudinal sliding slot of the holder block, and two retaining grooves respectively located on opposing front and rear sides of the bottom block, the bottom block of the rotating member being configured to engage one of the first steering-guiding portion and the second steering-guiding portion of the holder block and then to rotate to let one of the retaining grooves be forced into engagement with the second steering-guiding portion;

a sliding hook pivotally coupled at a rear side thereof to the sliding block and further comprising a stop wall, a side notch located on a lateral side thereof forward of the stop wall and a hook portion disposed at a front side of the side notch; and a link that is adapted to be connected to a second sliding rail of the sliding rail assembly near a rearward end of the second sliding rail, with the link comprising a hook portion adapted to engage the hook portion of the sliding hook.

20. The sliding rail assembly auto-opening mechanism and a sliding rail assembly combination as claimed in claim 19, wherein the sloping guide portion disposed at the front end of the guide groove of the holder block biases the sliding hook to rotate.

* * * * *